US010550657B2

(12) United States Patent
Levert, Jr. et al.

(10) Patent No.: US 10,550,657 B2
(45) Date of Patent: Feb. 4, 2020

(54) HYDRAULIC TOOL AND SEAL ASSEMBLY

(71) Applicant: Cameron International Corporation, Houston, TX (US)

(72) Inventors: Michael Levert, Jr., Katy, TX (US); Kyle Sommerfeld, Houston, TX (US); Robert Cridland, Leeds (GB)

(73) Assignee: Cameron International Corporation, Houston, TX (US)

( * ) Notice: Subject to any disclaimer, the term of this patent is extended or adjusted under 35 U.S.C. 154(b) by 177 days.

(21) Appl. No.: 15/455,090

(22) Filed: Mar. 9, 2017

(65) Prior Publication Data

US 2018/0258725 A1 Sep. 13, 2018

(51) Int. Cl.
*E21B 33/03* (2006.01)
*E21B 23/01* (2006.01)

(52) U.S. Cl.
CPC ..... *E21B 33/03* (2013.01); *E21B 23/01* (2013.01)

(58) Field of Classification Search
CPC ..... E21B 33/03; E21B 33/04; E21B 43/10; E21B 23/01; F16J 15/02
See application file for complete search history.

(56) References Cited

U.S. PATENT DOCUMENTS 3,926,457 A * 12/1975 Williams, Jr. ..... E21B 23/06 166/125
4,736,799 A 4/1988 Ahlstone
4,836,288 A 6/1989 Wester
5,069,288 A 12/1991 Singeetham
5,249,629 A 10/1993 Jennings
5,372,201 A 12/1994 Milberger
6,823,938 B1 11/2004 Milberger
7,231,970 B2 6/2007 Matusek et al.
8,474,537 B2 * 7/2013 Voss ..... E21B 33/038 166/338
8,973,653 B2 3/2015 Thornburrow et al.
2005/0133216 A1 6/2005 Bartlett
2010/0193195 A1 8/2010 Nguyen et al.
2011/0005774 A1 1/2011 Sinnoff et al.
2014/0166298 A1 6/2014 Fenwick
2014/0305631 A1 * 10/2014 Schulte ..... E21B 23/01 166/207
2015/0136394 A1 * 5/2015 Turley ..... E21B 43/10 166/285
2015/0252635 A1 9/2015 Hartley et al.
2016/0010404 A1 * 1/2016 Nguyen ..... E21B 19/10 166/77.51
2016/0032674 A1 * 2/2016 Nguyen ..... E21B 33/04 166/85.3
2016/0186502 A1 6/2016 Nguyen
2016/0265298 A1 * 9/2016 Nguyen ..... E21B 23/00
(Continued)

FOREIGN PATENT DOCUMENTS

EP 2518260 A1 10/2012
GB 2299104 A 9/1996

*Primary Examiner* — Michael R Wills, III
(74) *Attorney, Agent, or Firm* — Fletcher Yoder, P.C.

(57) ABSTRACT

A system includes a running tool that has a tool body, a first piston configured to move a sealing member of a seal assembly between sealed and unsealed positions between the seal assembly and a first tubular, and a second piston configured to move a lock member between locked and unlocked positions between the seal assembly and a second tubular.

20 Claims, 11 Drawing Sheets

(56) References Cited

U.S. PATENT DOCUMENTS

| | | | | |
|---|---|---|---|---|
| 2017/0226817 | A1* | 8/2017 | Richards | E21B 23/04 |
| 2018/0179838 | A1 | 6/2018 | Nguyen | |
| 2018/0179839 | A1 | 6/2018 | Nguyen | |

* cited by examiner

HYDRAULIC TOOL AND SEAL ASSEMBLY

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies generally include a wide variety of components and/or conduits, such as blowout preventers (BOPs), as well as various control lines, casings, valves, and the like, that control drilling and/or extraction operations.

Hangers (e.g., tubing hangers or casing hangers) may be used to support sections or strings of casing or tubing within a wellhead assembly. In addition, hangers may regulate pressures and provide a path for hydraulic control fluid, chemical injections, or the like to be passed through the wellhead and into the well bore. In such a system, various seals (e.g., annular seals) are often disposed between various components of the wellhead system, such as the tubing spool, casing spool, casing hanger, tubing hanger, pack off assembly, and so forth, to regulate and isolate pressure between such components. Unfortunately, installation of such seals may be time consuming, costly, and/or complex.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The presently disclosed embodiments include a hydraulically actuated running tool (e.g., seal assembly running tool) capable of installing a seal assembly within a wellhead in less time than typical running tools. Specifically, the hydraulically actuated running tool may utilize axial force as well as a partial rotation (e.g., less than one revolution) to install the seal assembly. Installing the seal assembly using both axial force and hydraulics may reduce the time and cost associated with setting up and operating a mineral extraction system. Specifically, in the disclosed embodiments, a plurality of pistons are sequentially actuated via a pressurized fluid to actuate components of the running tool to engage and secure the seal assembly in the wellbore. Subsequently, the running tool may be released from the seal assembly by partial rotation (e.g., less than one revolution), or in some embodiments, no rotation. The running tool may then be retrieved from the wellhead assembly.

Reducing an amount of rotation that the running tool incurs to install the seal assembly may reduce a number of parts that may be included in the running tool. Accordingly, a height and/or overall size of the running tool may be reduced as a result of fewer components that are included in the running tool. Additionally, a hydraulic fluid system that may be utilized to actuate and/or drive components of the running tool may be less complex because such hydraulic system may not be utilized to cause the running tool to rotate.

Figure 1:
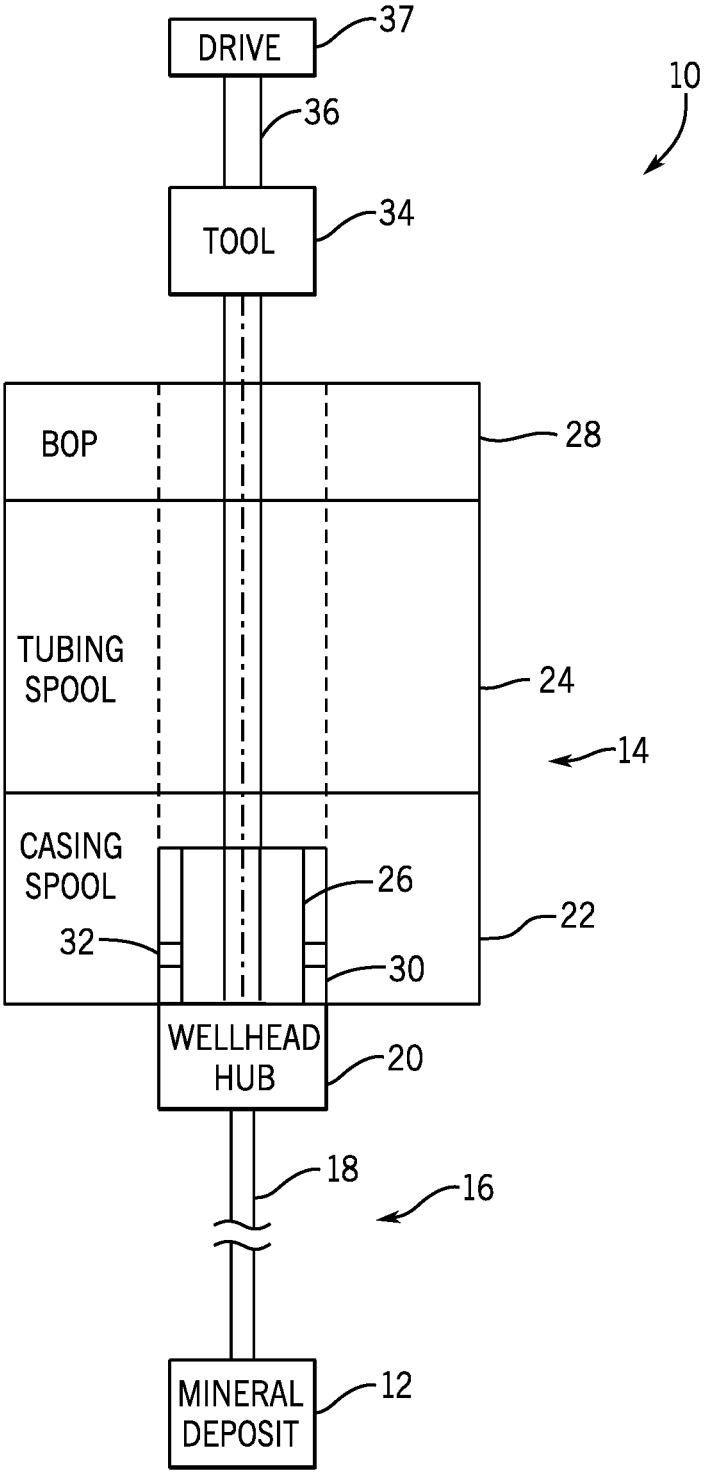
FIG. 1 is a schematic of an embodiment of a mineral extraction system, in accordance with an aspect of the present disclosure.

FIG. 1 is a schematic of an exemplary mineral extraction system 10 configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the reservoir 12 to a wellhead hub 20 located at or near the surface.

The illustrated wellhead hub 20, which may be a large diameter hub, acts as an early junction between the well 16 and the equipment located above the well. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the well bore 18, provide for regulating pressure in the well 16, and provide for the injection of chemicals into the well bore 18 (downhole). In the illustrated embodiment, the wellhead 14 includes a casing spool 22 (e.g., tubular), a tubing spool 24 (e.g., tubular), a seal assembly 26 (e.g., to provide a seal between a hanger and/or another component and the casing spool 22), and a blowout preventer (BOP) 28.

In operation, the wellhead 14 enables completion and workover procedures, such as tool insertion into the well 16 for installation and removal of various components (e.g., hangers, shoulders, packoffs, etc.). Further, minerals extracted from the well 16 (e.g., oil and natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the well bore 18 for various completion and workover procedures, such as emplacing tools or components within the casing spool 22. To emplace the components, a shoulder 32 provides a temporary or permanent landing surface that can support pieces of equipment (e.g., hangers, seal assemblies, packoffs, among others). For example, the illustrated embodiment of the extraction system 10 includes a tool 34 suspended from a drill string 36. In certain embodiments, the tool 34 may include running tools (e.g., seal assembly running tools, hanger running tools, shoulder running tools, slip tools, etc.) that are lowered (e.g., run) to the well 16, the wellhead 14, and the like. The seal assembly 26 may be installed on the shoulder 32 and used to seal components that may be utilized to support sections of casing or tubing within the wellhead assembly 14.

Figure 2:
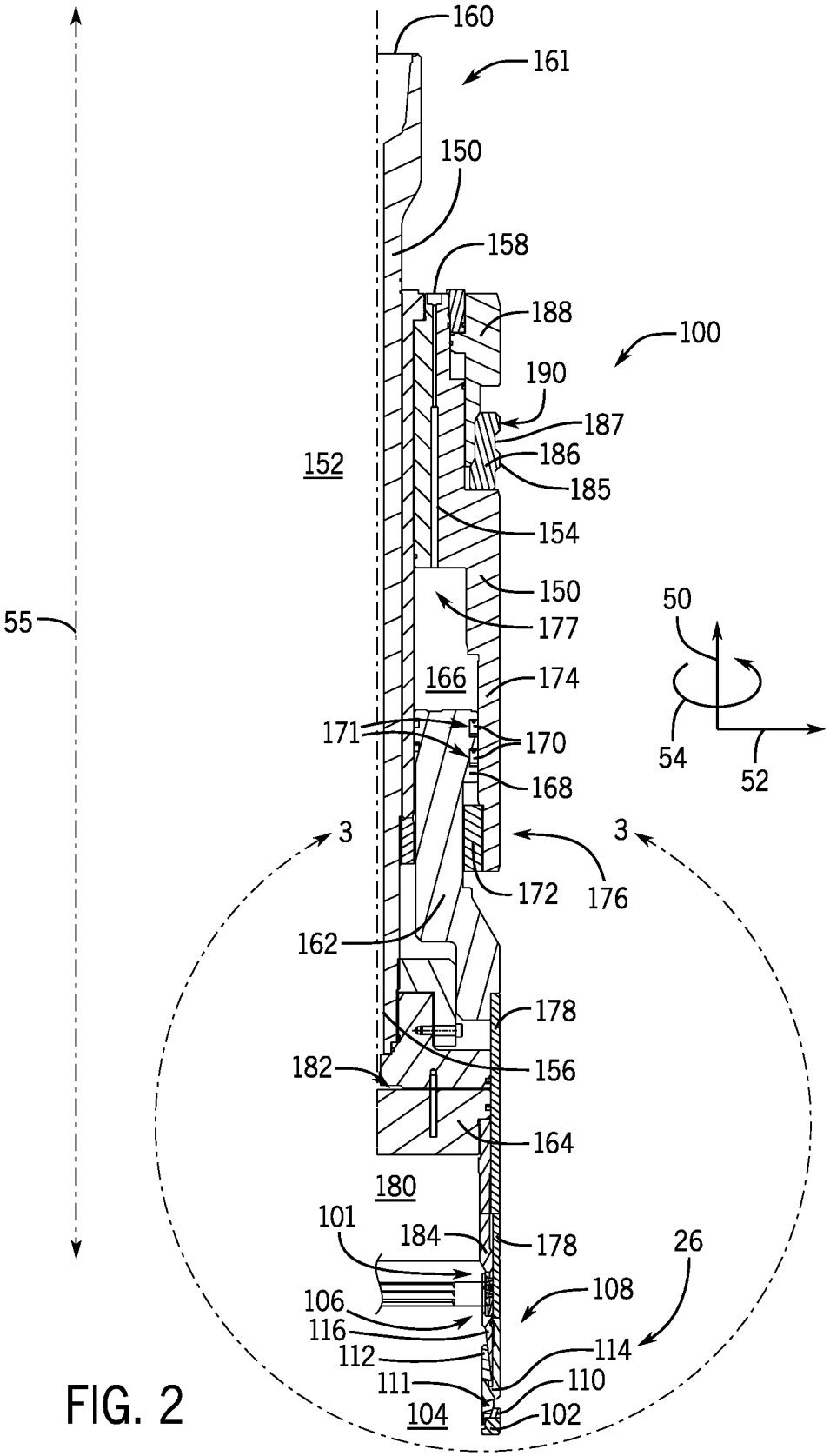
FIG. 2 is a partial, cross-sectional view of an embodiment of a running tool for a seal assembly, in accordance with an aspect of the present disclosure.

FIG. 2 is a side, section view of a seal assembly running tool 100 being coupled to a seal assembly 26 (e.g., a packoff) for installation in a wellhead assembly 14. The running tool 100 is coupled to the seal assembly 26 before the running tool 100 is inserted into the wellhead assembly 14. For example, the seal assembly running tool 100 may be coupled to the seal assembly 26 on the rig floor. In some embodiments, the running tool 100 may be coupled to the seal assembly 26 via a breech connection 101 (e.g., breech lock couplings). As used herein, a breech connection 101 may be a securement configuration between the running tool 100 and the seal assembly 26. The breech connection 101 may enable the running tool 100 and the seal assembly 26 to be coupled to one another by rotation of the running tool 100. In some embodiments, the running tool 100 may be rotated less than a full rotation (e.g., less than 360 degrees, less than 180 degrees, or less than 100 degrees) to couple and/or de-couple the running tool 100 and the seal assembly 26. In certain embodiments, the breech connection 101 may include radial fasteners (e.g., disposed on the running tool 100) that may be received in corresponding "J" slots of the seal assembly 26. When the radial fasteners are disposed in the "J" slots, the running tool 100 may be rotated (e.g., less than a full rotation) to couple the running tool 100 to the seal assembly 26.

While the present discussion focuses on the running tool 100 coupled to the seal assembly 26 using the breech connection 101, it should be understood that other coupling techniques may be utilized. For example, the running tool 100 may be coupled to the seal assembly 26 by one or more shear pins (see, e.g., FIG. 10). For example, the shear pins may extend into both the running tool 100 and the seal assembly 26 to secure the seal assembly 26 to the running tool 100. Therefore, the running tool 100 may direct the seal assembly 26 into the wellhead assembly 14. To de-couple the running tool 100 from the seal assembly 26, the running tool 100 may be directed in an axial direction toward the seal assembly 26, such that the shear pins shear (e.g., break) and enable the running tool 100 to move within the wellhead assembly 14 independent of the seal assembly 26. Utilizing shear pins to couple the running tool 100 to the seal assembly 26 may enable the running tool 100 to run (e.g., direct the seal assembly 26 into the wellhead assembly 26), seal, and set the seal assembly 26 without using rotational force.

For reference, a coordinate system is shown comprising an axial direction or axis 50, a radial direction or axis 52, and a circumferential direction or axis 54 relative to a central axis 55. It should be noted that FIGS. 2-9 are partial cross-sections of embodiments of the seal assembly running tool 100 on only a right-hand side of the central axis 55. Unless stated otherwise, each illustrated feature of FIGS. 2-9 is annular and extends circumferentially about the central axis 55.

The seal assembly 26 includes a generally annular body 102, which defines a bore 104 and a mounting interface 106 (e.g., the breech connection 101), which may be used to couple to the running tool 100. The body 102 of the seal assembly 26 may include one or more movable members 108 (e.g., axial and/or radial moving members) that may be configured to be engaged by the running tool 100. For example, the seal assembly 26 may include a sealing member 110 (e.g., a sealing ring or another suitable sealing device), an additional sealing member 111 (e.g., a sealing ring, a split ring, a c-ring, or another suitable sealing device, as well as a lock member 112 (e.g., a lock ring or one or more radial locking dogs). The sealing member 110 may be configured to form a seal between the seal assembly 26 and a tubular (e.g., the casing spool 22) of the wellhead assembly 14 and the additional sealing member 111 may form a seal between the seal assembly 26 and a hanger, for example.

In some embodiments, a first push member 114 (e.g., a first push ring) may be configured to direct the sealing member 110 and/or the additional sealing member 111 along the radial axis 52. For example, the first push member 114 may direct the sealing member 110 radially away from the seal assembly 26 and toward the tubular of the wellhead assembly 14 (e.g., in a first radial direction). Additionally, the first push member 114 may direct the additional member 111 radially inward from the seal assembly 26 and toward the hanger (e.g., in a second radial direction). The lock member 112 may be configured to secure the seal assembly 26 to a tubular (e.g., the drill string 36) disposed in the bore 104 of the seal assembly 26. Accordingly, a second push member 116 (e.g., a second push ring) may be included in the seal assembly 26 to direct the lock member 112 along the radial axis 52, such that the lock member 112 may move radially inward toward a tubular (or another component) disposed in the bore 104 of the seal assembly 26. Accordingly, the seal assembly 26 may provide a seal between the tubular of the wellhead assembly 14 and the tubular within the bore 104 of the seal assembly 26. While the illustrated embodiment of FIG. 2 shows the seal assembly 26 having the seal member 110, the additional sealing member 111, and the lock member 112 as angled wedge rings (e.g., annular wedge components), in other embodiments, the seal assembly 26 may include any other suitable configuration that may be secured and sealed using an axial force applied by the running tool 100.

The running tool 100 includes an annular body 150, which defines a bore 152. The body 150 also defines first and second fluid passages 154, 156, which may be pressurized by a pressurized fluid (e.g., hydraulically, pneumatically, etc.) in order to actuate various components of the hanger running tool 100, which may engage components (e.g., the first push member 114 and/or the second push member 116) of the seal assembly 26. The first and second fluid passages 154, 156 may be in fluid communication with first and second pressure ports 158, 160, disposed at a first axial end 161 of the hanger running tool 100. Fluid (e.g., air, hydraulic fluid, oil, water, etc.) in the passages 154, 156 may be pressurized from one or more pressurized fluid sources (e.g., fluid pumps, tanks, accumulators, etc.) through applying pressure via the first and second pressure ports 158, 160.

The pressure ports 158, 160 and corresponding fluid passages 154, 156 may supply a pressure force to one or more pistons of the running tool 100. For example, the running tool 100 may include a first piston 162 (e.g., an upper piston or an outer piston) and a second piston 164 (e.g., a lower piston or an inner piston). The first piston 162 may be generally annular in shape (e.g., annular piston) and disposed within a cavity 166 (e.g., an annular cavity) formed in the body 150. The first piston 162 includes an annular protrusion 168 that protrudes radially toward the body 150, such that the first piston 162 is secured within the cavity 166 of the body 150. The annular protrusion 168 of the first piston 162 may include one or more seals 170 (e.g., o-rings) disposed in recesses 171 that form a seal between the first piston 162 and the body 150. As shown in the illustrated embodiment of FIG. 2, the body 150 includes a shoulder 172 (e.g., annular shoulder or surface), resulting from a change in the outside diameter of the body 150 from a first annular portion 174 (e.g., smaller diameter portion) to a second annular portion 176 (e.g., larger diameter portion). Accordingly, the annular protrusion 168 may be blocked from moving along the axial direction 50 out of the cavity 166 by the shoulder 172. The first piston 162 may be configured to move in the axial direction 50 back and forth within the cavity 166, thereby increasing and decreasing a first volume 177 (e.g., annular volume or piston-cylinder chamber) of the cavity 166. The first piston 162 may be coupled to a third push member 178 (e.g., a linkage, rod, sleeve, or elongated structure), which may be used to actuate the first push member 114 of the seal assembly 26. In certain embodiments, the third push member 178 may include one or more push rods spaced circumferentially about the central axis 55.

The second piston 164 (e.g., annular piston) may be disposed within a second cavity 180 of the body 150. The second cavity 180 may form a second volume 182 (e.g., annular volume or piston-cylinder chamber), which is in fluid communication with the second pressure port 160. The second piston 164 moves back and forth in the axial direction 50 relative to the body 150, causing the second volume 182 to expand or contract. The second piston 164 may be coupled to a fourth push member 184, which may be configured to actuate the second push member 116 of the seal assembly 26. It should be noted that while the illustrated embodiment of FIG. 2 shows the first pressure port 158 and the first fluid passage 154 controlling a position of the first piston 162 and the second pressure port 160 and the second fluid passage 156 controlling a position of the second piston 164, in other embodiments, the first pressure port 158 and the first fluid passage 154 may be configured to control the position of the second piston 164 and the second pressure port 160 and the second fluid passage 156 may control the position of the first piston 162.

As shown in the illustrated embodiment of FIG. 2, the running tool 100 may include a lock ring 186 (e.g., an annular lock ring) that may be configured to secure the running tool 100 within the wellhead assembly 14 when the running tool 100 is disposed (e.g., run) in the wellhead assembly 14. For example, a fifth push member 188 may engage the lock ring 186, thereby directing the lock ring 186 radially outward from the body 150 of the running tool 100 and toward a tubular (e.g., the casing spool 22) of the wellhead assembly 14. In some embodiments, the lock ring 186 may be received in a recess of the tubular (e.g., the casing spool 22) and secured in the recess by various protrusions 185 and recesses 187 that define an external surface 190 of the lock ring 186. The recess of the tubular may include corresponding protrusions and recesses that may engage the external surface 190 of the lock ring 186, such that movement of the running tool 100 with respect to the tubular is blocked. When the running tool 100 is secured to the tubular of the wellhead assembly 14, the seal assembly 26 may be engaged.

Figure 3:
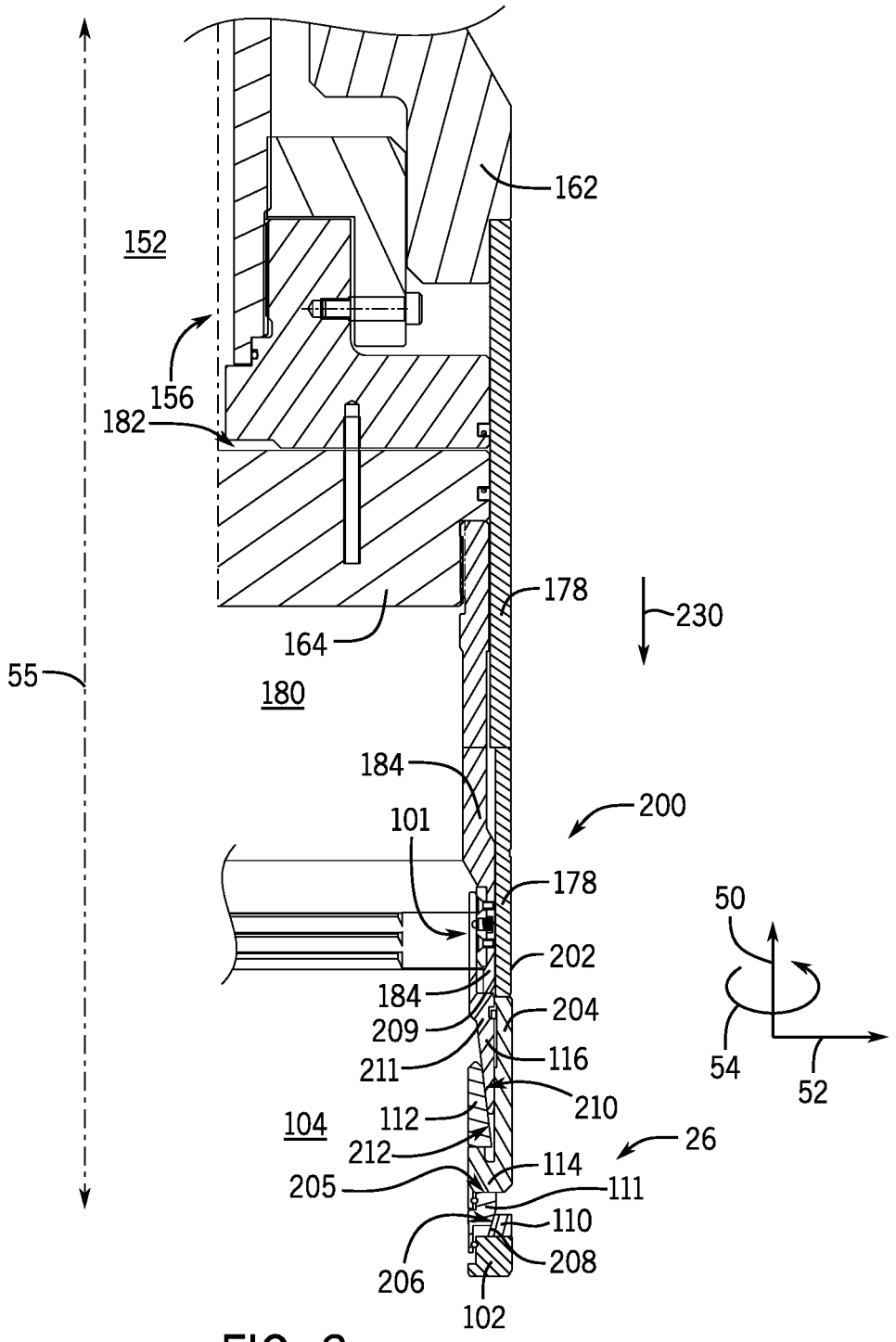
FIG. 3 is a partial, cross-sectional view of an embodiment of the seal assembly of FIG. 2, in accordance with an aspect of the present disclosure.

FIG. 3 is a partial cross-section of an embodiment of the seal assembly 26 and a second axial end 200 of the running tool 100. As shown in the illustrated embodiment of FIG. 3, a first axial end 202 of the third push member 178 may engage a first axial end 204 of the first push member 114 of the seal assembly 26. Accordingly, as the first piston 162 moves downward in the axial direction 50 (e.g., when a pressure force is applied to the first piston 162 via the first pressure port 158), the third push member 178 may drive the first push member 114 in the axial direction 50 (e.g., see FIGS. 4 and 5) as indicated by arrow 230. The first push member 114 may actuate the sealing member 110 and/or the additional sealing member 111. For example, a surface 205 of the first push member 114 may engage the additional sealing member 111. Accordingly, a first tapered surface 206 (e.g., an annular tapered surface, a conical surface, or another energizing surface) of the additional sealing member 111 may contact and engage a second tapered surface 208 (e.g., an annular tapered surface, a conical surface, or another energizing surface) of the sealing member 110. The first tapered surface 206 may engage the second tapered surface 208 to direct the sealing member 110 in the radial direction 52 (e.g., outward radial direction) toward the tubular of the wellhead assembly 14 and to direct the additional sealing member 111 in the radial direction 52 toward a hanger disposed within the bore 104.

In some embodiments, the first tapered surface 206 interfaces with the second tapered surface 208, such that the sealing member 110 moves radially outward (e.g., in a first radial direction) from an unsealed position toward a sealed position and/or the additional sealing member 111 moves radially inward (e.g., in a second radial direction) from an unsealed position toward a sealed position. Correspondingly, when the first piston 162 moves upward in the axial direction 50, the sealing member 110 expands radially inward (e.g., in the second radial direction) from the sealed position toward the unsealed position and/or the additional sealing member 111 moves radially outward (e.g., in the first radial direction) from the sealed position toward the unsealed position. As discussed above, the seal assembly 26 may include other configurations than those illustrated in FIGS. 2 and 3. In any case, the sealing member 110 of the seal assembly 26 may be set when the third push member 178 applies an axial force (e.g., the seal assembly 26 may not include the first push member 114).

Additionally, a first axial end 209 of the fourth push member 184 may engage a first axial end 211 of the second push member 116. When the second piston 164 moves downward in the axial direction 50 (e.g., when a pressure force is applied to the second piston 164 via the first pressure port 158), the fourth push member 184 may direct the second push member 116 in the axial direction 50 as indicated by arrow 230. In some embodiments, the second push member 116 may include a third tapered surface 210 (e.g., an annular tapered surface, a conical surface, or another energizing surface) that may engage a fourth tapered surface 212 (e.g., an annular tapered surface, a conical surface, or another energizing surface) of the lock member 112. The third tapered surface 210 may engage the fourth tapered surface 212 to direct the lock member 112 in the inward radial direction 52 (e.g., in the second radial direction) toward the tubular disposed in the bore 104 of the seal assembly 26. The third tapered surface 210 interfaces with the fourth tapered surface 212, such that the lock member 112 moves radially inward from an unlocked position toward a locked position. Correspondingly, when the second piston 164 moves upward in the axial direction 50, the lock member 112 expands radially outward from the locked position toward the unlocked position.

In some embodiments, the sealing member 110 and/or the additional sealing member 111 may be engaged (e.g., actuated) before the lock member 112, such that the seal assembly 26 forms the seal before the seal assembly 26 is secured to (or within) the wellhead assembly 14. Accordingly, the lock ring 186 of the running tool 100 may secure both the running tool 100 and the seal assembly 26 within the wellhead assembly 14 as the seal, or seals, are formed. However, in other embodiments, the lock member 112 may be engaged before the sealing member 110 and/or the additional sealing member 111, or the lock member 112 and the sealing member 110 may be engaged (e.g., actuated) at substantially the same time (e.g., generally simultaneously).

Figure 4:
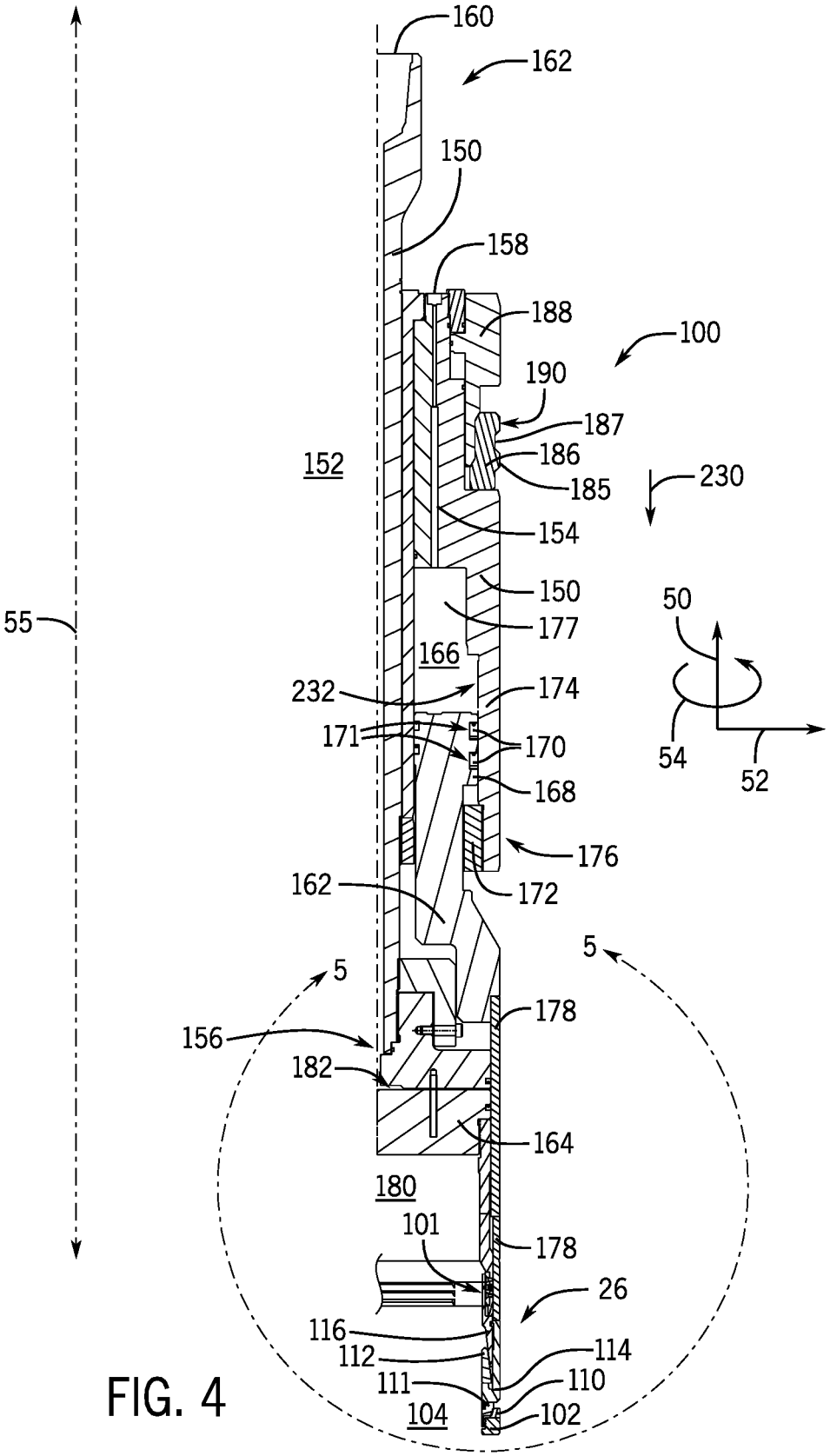
FIG. 4 is a partial, cross-sectional view of an embodiment of the running tool of FIG. 2 when a first piston of the running tool is actuated, in accordance with an aspect of the present disclosure.

FIG. 4 is a partial cross-section of the running tool 100 and the seal assembly 26 disposed in the wellhead assembly 14. Additionally, FIG. 4 illustrates actuation of the first piston 162, in that the first piston 162 has been directed in the axial direction 50 toward the seal assembly 26. As shown in the illustrated embodiment of FIG. 4, pressure applied to the first piston 162 (e.g., via the first pressure port 158) may drive the first piston 162 downward in the axial direction 50, as shown by arrow 230. As discussed above, the first passage 154 may be pressurized by applying a pressure (e.g., hydraulically or pneumatically) to the first pressure port 158. As the pressure in the first passage 154 increases, the pressure in the cavity 166, which is in fluid communication with the first passage 154, also increases, pushing the first piston 162 downward in the axial direction 50, indicated by the arrow 230. As the first piston 162 moves downward in the axial direction 50, the first tapered surface 206 interfaces with the second tapered surface 208, thereby directing the sealing member 110 and the additional sealing member 111 in the radial direction 52 (e.g., outward radial direction). In other embodiments, the third push member 178 may include the first tapered surface 206 and engage the sealing member 110 directly and/or engage other components of the seal assembly 26 to set the sealing member 110 (e.g., the seal assembly 26 may not include the additional sealing member 111). The first piston 162 may move in the axial direction 50 (e.g., as shown by the arrow 230) within the cavity 166. In some embodiments, walls 232 of the cavity 166 may block movement of the first piston 162 in the radial direction 52, such that the walls 232 of the cavity 166 act as an axial guide for the first piston 162.

Figure 5:
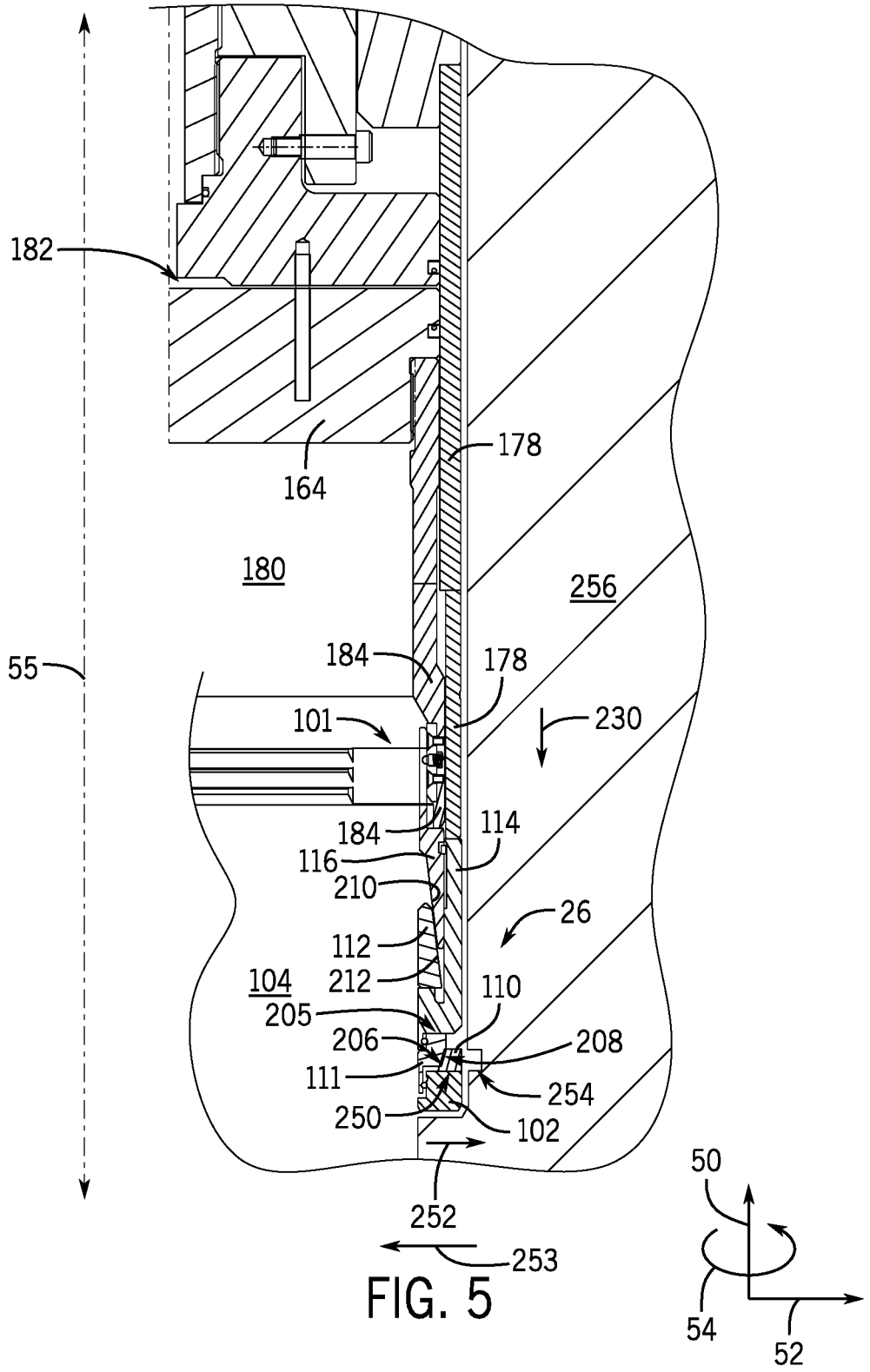
FIG. 5 is a partial, cross-sectional view of an embodiment of the seal assembly of FIG. 4 when the first piston of the running tool is actuated, in accordance with an aspect of the present disclosure.

When the first piston 162 moves downward in the axial direction 50, the third push member 178 may engage the first push member 114 of the sealing member 110. In other embodiments, the third push member 178 may engage the sealing member 110 (or the additional sealing member 111) directly and/or engage other components of the seal assembly 26 to set the sealing member 110. FIG. 5 is a partial, cross-section of an embodiment of the running tool 100 when the first piston 162 has been moved downward in the axial direction 50 into a sealed position 250 (e.g., a pressure force is applied to the first piston 162 via the first pressure port 158). Accordingly, the first tapered surface 206 may engage the second tapered surface 208 to direct the sealing member 110 in the radial direction 52 (e.g., outward radial direction), as shown by arrow 252 (e.g., the first radial direction). In some embodiments, the additional sealing member 111 may also be directed in the radial direction 52, as shown by arrow 253 (e.g., the second radial direction). In some embodiments, the sealing member 110 may be directed into a groove or recess 254 (e.g., annular groove) of a tubular 256 (e.g., the casing spool 22) of the wellhead assembly 14 to form a seal between the seal assembly 26 and the tubular 256. In other embodiments, the sealing member 110 may engage a wall of the tubular 256 without being disposed in the recess 254. Similarly, the additional sealing member 111 may be directed into a recess of the hanger disposed in the bore 104 and/or otherwise engage a wall (e.g., cylindrical inner surface) of the hanger to form a seal between the seal assembly 26 and the hanger.

Figure 6:
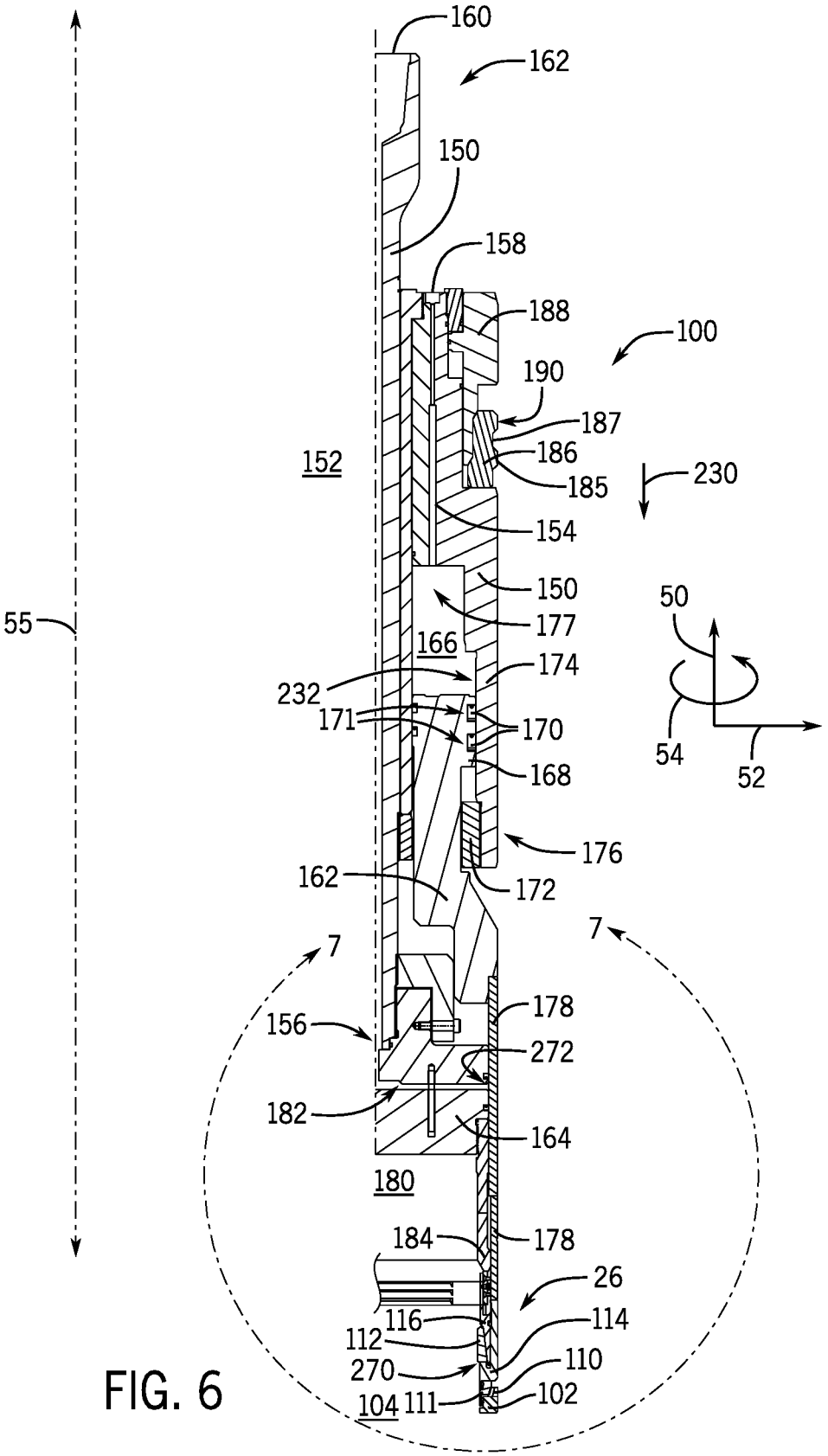
FIG. 6 is a partial, cross-sectional view of an embodiment of the seal assembly of FIG. 2 when a second piston of the running tool is actuated, in accordance with an aspect of the present disclosure.

Further, the second piston 164 may also be moved downward in the axial direction 50, as shown by the arrow 230. For example, FIG. 6 is a partial cross section of the running tool 100 when the second piston is moved downward in the axial direction 50, and thus, is in a locked position 270. As shown in the illustrated embodiment of FIG. 6, pressure applied to the second piston 164 (e.g., via the second pressure port 160) may drive the second piston 164 to move downward in the axial direction 50, as shown by the arrow 230. As discussed above, the second passage 156 may be pressurized by applying a pressure (e.g., hydraulically or pneumatically) to the second pressure port 160. As the pressure in the second passage 156 increases, the pressure in the second volume 182, which is in fluid communication with the second passage 156, also increases, pushing the second piston 164 downward in the axial direction 50, indicated by the arrow 230. As the second piston 164 moves downward in the axial direction 50, the third tapered surface 210 interfaces with the fourth tapered surface 212 (see FIG. 7), thereby contracting the lock member 112 in the radial direction 52 (e.g., inward radial direction). The second piston 164 may move in the axial direction 50 (e.g., as shown by the arrow 230) within the second cavity 180. In some embodiments, walls 272 of the second cavity 180 may block movement of the second piston 164 in the radial direction 52, such that the walls 272 of the second cavity 180 act as an axial guide for the second piston 180.

Figure 7:
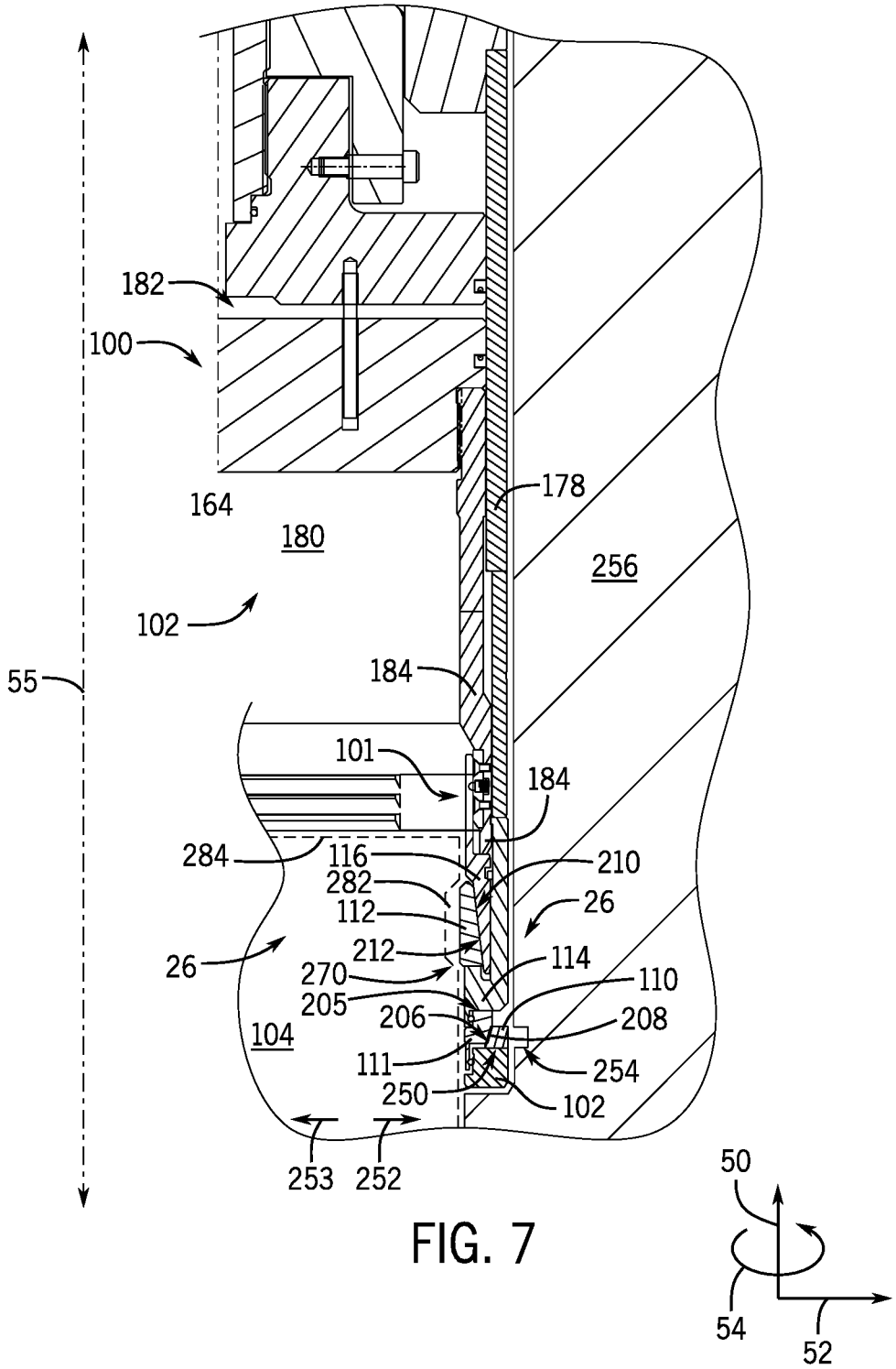
FIG. 7 is a partial, cross-sectional view of an embodiment of the seal assembly of FIG. 6 when the second piston of the running tool is actuated, in accordance with an aspect of the present disclosure.

When the second piston 164 moves downward in the axial direction, the fourth push member 184 may engage the second push member 116. For example, FIG. 7 is a partial, cross-section of an embodiment of the running tool 100 when the second piston 164 has been moved downward in the axial direction 50 into the locked position 270 (e.g., a pressure force is applied to the second piston 164 via the second pressure port 160). Accordingly, the third tapered surface 210 may engage the fourth tapered surface 212 to move the lock member 112 in the radial direction 52 (e.g., inward radial direction), as shown by arrow 253. In some embodiments, the lock member 112 may be moved into a groove or recess 282 (e.g., annular groove) of a tubular 284 (e.g., the hanger) disposed in the bore 104 of the seal assembly 26 to secure the seal assembly 26 to the tubular 284. In other embodiments, the sealing member 112 may engage a wall (e.g., cylindrical surface) of the tubular 284 without being disposed in the recess 282.

Figure 8:
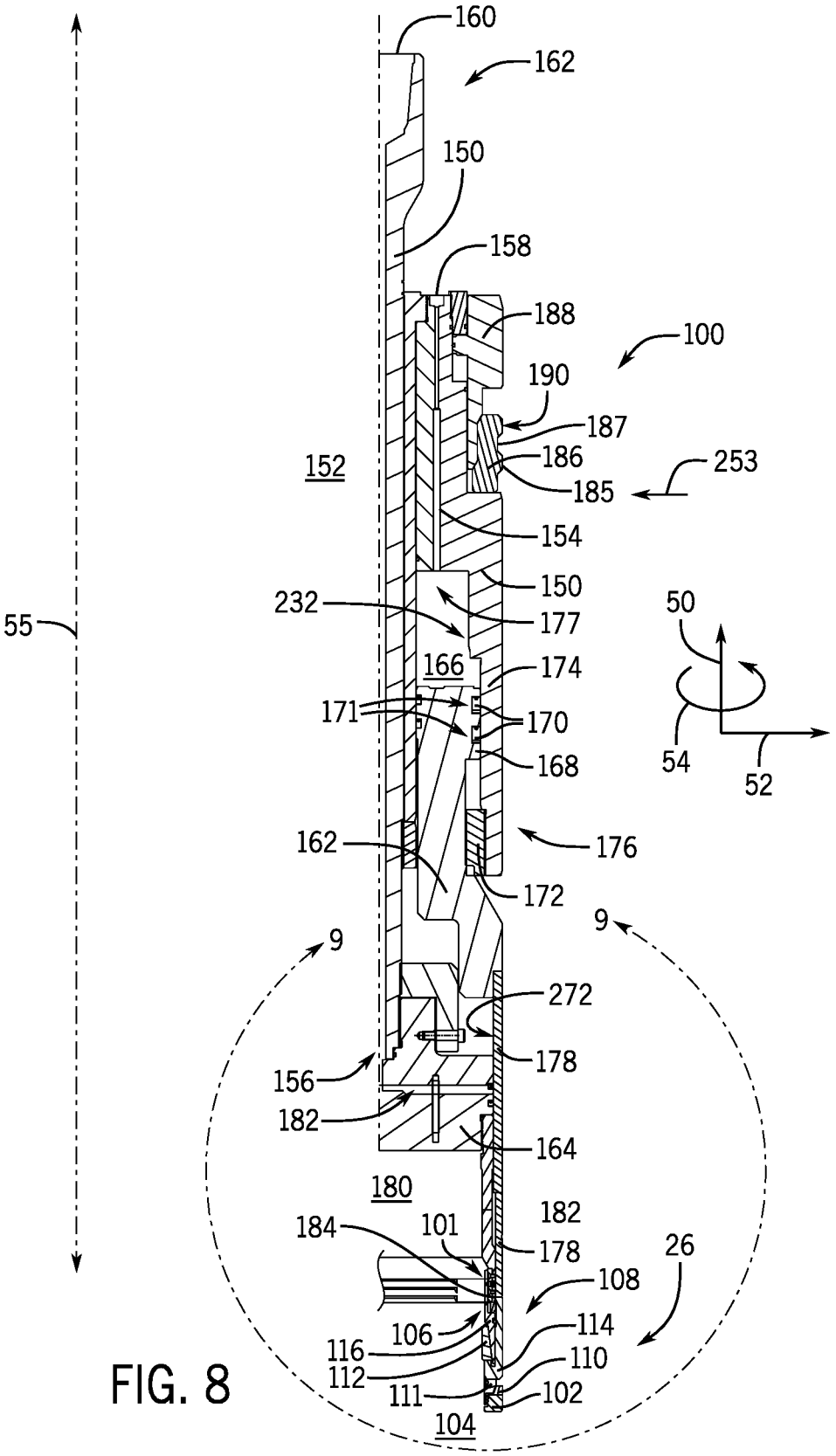
FIG. 8 is a partial, cross-sectional view of an embodiment of the running tool of FIG. 2 being removed from the seal assembly, in accordance with an aspect of the present disclosure.

Once the seal assembly 26 has been coupled to the tubular 284, the running tool 100 may release the seal assembly 26. For example, FIG. 8 is a side, section, detail view illustrating disengagement of a locked position of the running tool 100 with the seal assembly 26. To decouple the running tool 100 from the seal assembly 26, a pressure (e.g., a hydraulic pressure or pneumatic pressure) may be relieved (e.g., removed from another pressure port or by opening the pressure ports 158 and/or 160) from the first passage 154 and the second passage 156. Additionally, the lock ring 186 of the running tool 100 may be disengaged (e.g., unsecured), such that the lock ring 186 contracts radially inward toward the body 150 of the running tool 100, as shown by the arrow 253.

Figure 9:
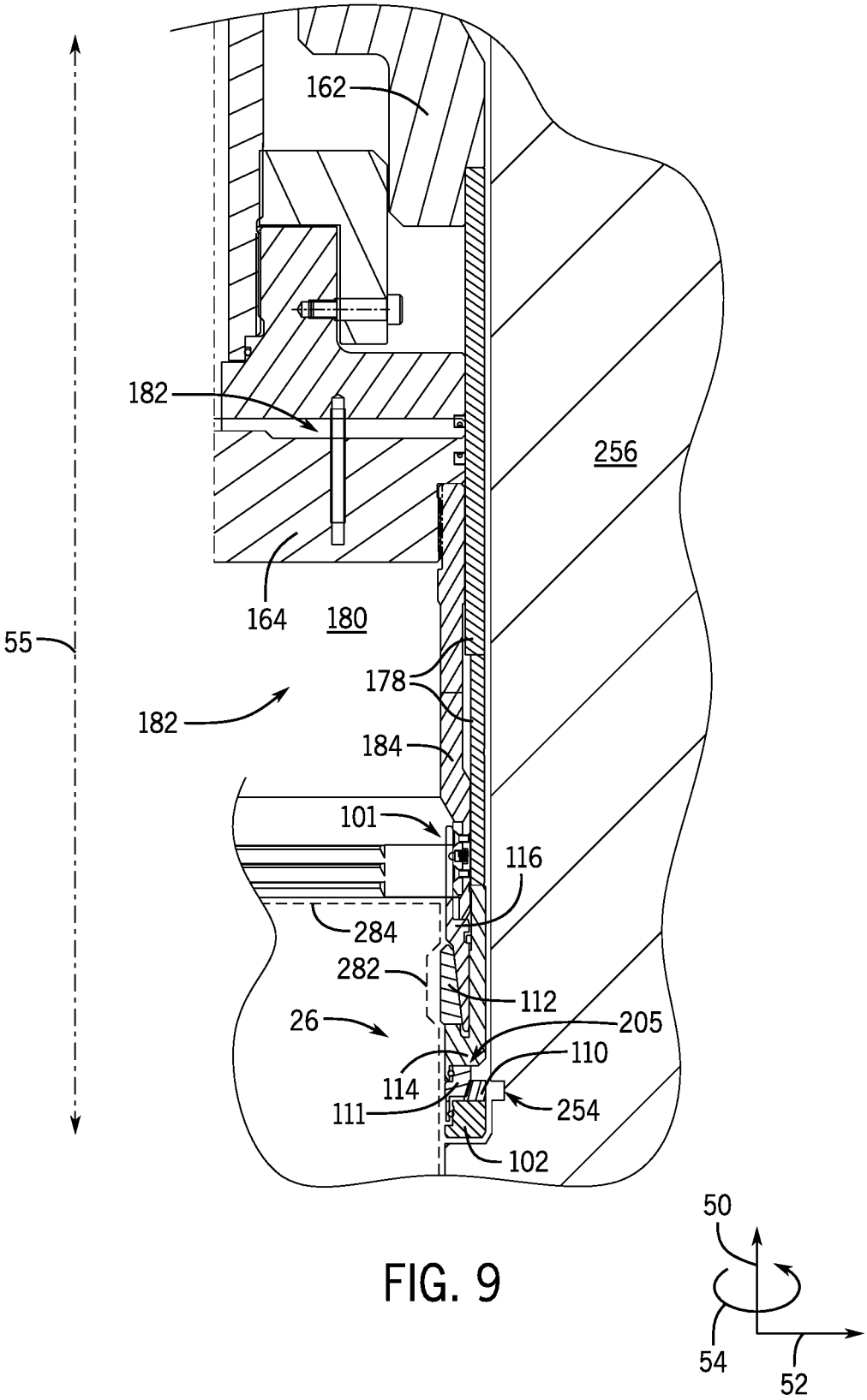
FIG. 9 is a partial, cross-sectional view of an embodiment of the seal assembly of FIG. 8 when the running tool is being removed from the seal assembly, in accordance with an aspect of the present disclosure.

The breech connection 101 between the running tool 100 and the seal assembly 26 may then be removed, as shown in FIG. 9. For example, the running tool 100 may be rotated (e.g., less than a full rotation) in the circumferential direction 54 with respect to the seal assembly 26 to disengage the radial fasteners from the "J" slots and remove the connection between the running tool 100 and the seal assembly. Accordingly, the running tool 100 may be moved in the axial direction 50 out of the wellhead assembly 14, while the seal assembly 26 remains in the wellhead assembly 14 and maintains the seal.

Figure 10:
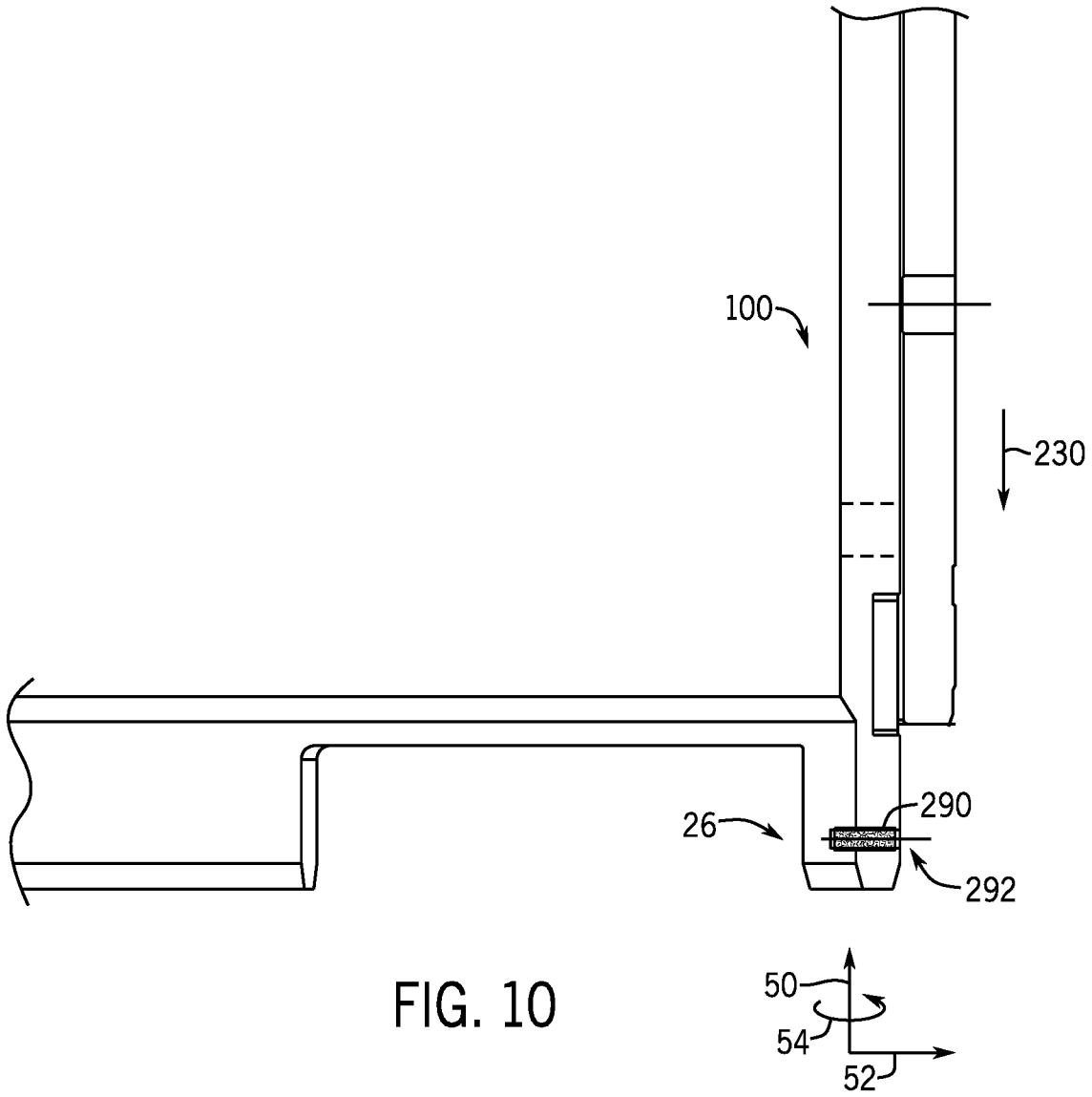
FIG. 10 is a partial cross-sectional view of an embodiment of a connection between the running tool and the seal assembly, in accordance with an aspect of the present disclosure.

FIG. 10 is a partial cross-section of an embodiment of a connection between the running tool 100 and the seal assembly 26 that includes one or more shear pins 290 instead of the breech connection 101. For example, the one or more shear pins 290 may extend into both the running tool 100 and the seal assembly 26 through an opening 292, such that the seal assembly 26 is secured to the running tool 100. When the running tool 100 and the seal assembly 26 are coupled to one another by the one or more shear pins 290, the running tool 100 may direct the seal assembly 26 into the wellhead assembly 14. To de-couple the running tool 100 from the seal assembly 26, the running tool 100 may be moved in the axial direction 50, as shown by the arrow 230, toward the seal assembly 26, such that the one or more shear pins 290 shear (e.g., break). Shearing the one or more shear pins 290 disconnects the running tool 100 from the seal assembly 26 and enables the running tool 100 to move within the wellhead assembly 14 independent of the seal assembly 26. Utilizing shear pins to couple the running tool 100 to the seal assembly 26 may enable the running tool 100 to run (e.g., direct the seal assembly 26 into the wellhead assembly 26), seal the seal assembly 26, and lock the seal assembly 26 without using rotational force.

Figure 11:
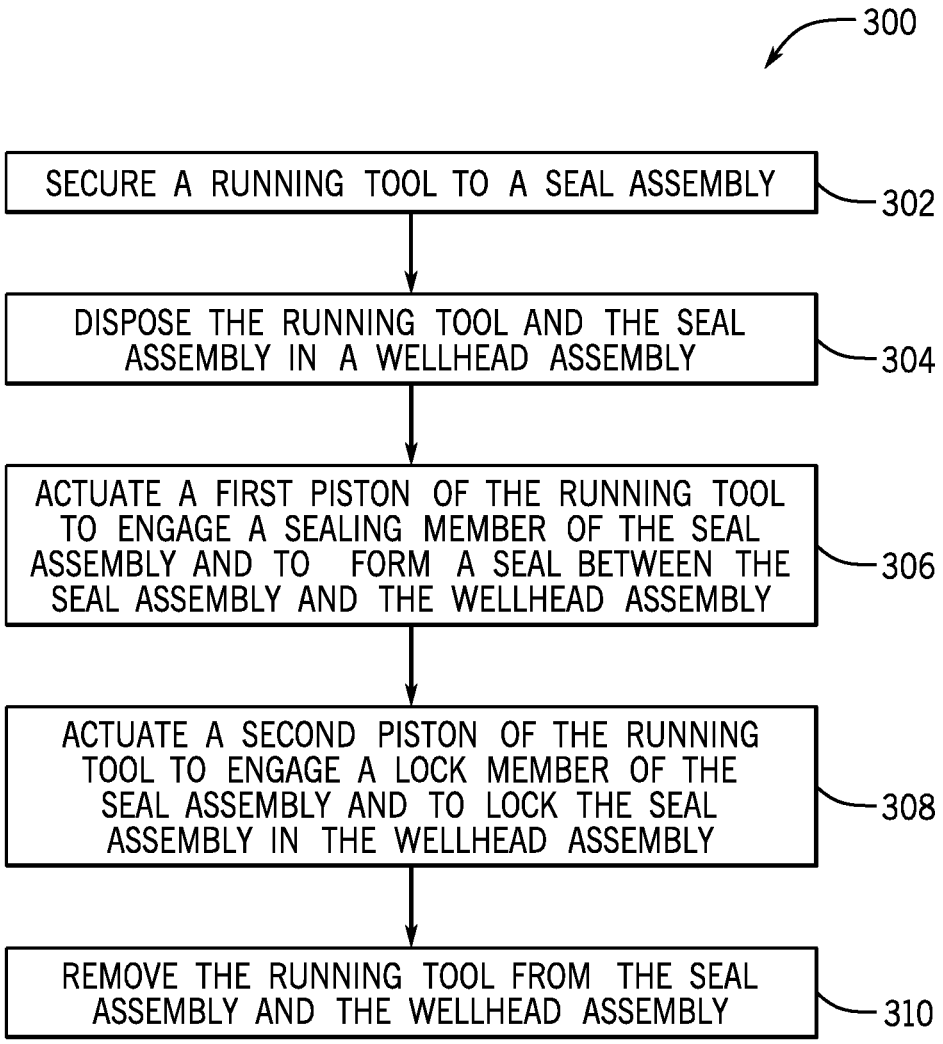
FIG. 11 is a flow chart of an embodiment of a process that may be performed to utilize the running tool to seal and secure the seal assembly in a wellhead assembly, in accordance with an aspect of the present disclosure.

FIG. 11 is a flow chart of an embodiment of a process 300 that may be performed to secure the seal assembly 26 within the wellhead assembly 14 using the running tool 100. For example, at block 302, the running tool 100 may be secured to the seal assembly 26. As discussed above, in some embodiments, the connection between the running tool 100 and the seal assembly 26 may be formed by the breech connection 101 (e.g., radial fasteners of the running tool 100 that are disposed in corresponding "J" slots of the seal assembly 26). In other embodiments, the connection between the running tool 100 and the seal assembly 26 may be formed using the one or more shear pins 290 and/or another suitable technique (e.g., threads).

At block 304, the running tool 100 and the seal assembly 26 may be disposed (e.g., run) into the wellhead assembly 14 and secured to the wellhead assembly 14. In some embodiments, the lock ring 186 of the running tool 100 may secure the running tool 100 and seal assembly 26 to the wellhead assembly 14, such that the seal may be formed. At block 306, the first piston 162 of the running tool 100 may be actuated (e.g., via pressure supplied through the first pressure port 158) to direct the third push member 178 to engage the first push member 114. The first push member 114 may then engage the additional sealing member 111, such that the sealing member 110 moves radially outward to form a seal between the seal assembly 26 and the tubular 256 of the wellhead assembly 14 and the additional sealing member 111 moves radially inward to form a seal between the seal assembly 26 and the hanger.

At block 308, the second piston 164 of the running tool 100 may be actuated (e.g., via pressure supplied through the second pressure port 160) to direct the fourth push member 184 to engage the second push member 116. Accordingly, the second push member 116 may engage the lock member 112, such that the lock member 112 moves radially inward to secure the seal assembly 26 to the tubular 284 disposed in the bore 104 of the seal assembly 26. As discussed above, blocks 306 and 308 may occur sequentially or simultaneously. In any case, once the seal assembly 26 is secured in the wellhead assembly 26, the running tool 100 may be unsecured (e.g., de-coupled) from the seal assembly 26 and removed from the wellhead assembly 14, as shown at block 310. For example, the lock ring 186 of the running tool 100 may be disengaged and the breech connection 101 between the running tool 100 and the seal assembly 26 may be removed (e.g., de-coupled by rotating the running tool 100 less than one full rotation). Accordingly, the running tool 100 may be moved in the axial direction 50 out of the wellhead assembly 14, while the seal assembly 26 remains in the wellhead assembly 14 to maintain a seal.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a running tool, comprising:

a tool body;

a first piston configured to move a sealing member of a seal assembly between sealed and unsealed positions between the seal assembly and a first tubular, wherein the first piston is configured to move the sealing member into a recess of the first tubular for the sealed position; and a second piston configured to move a lock member between locked and unlocked positions between the seal assembly and a second tubular.

2. The system of claim 1, wherein the first and second pistons are fluid driven pistons.

3. The system of claim 2, comprising a first fluid passage configured to supply fluid to drive the first piston from the unsealed position to the sealed position and a second fluid passage configured to drive the second piston from the unlocked position to the locked position.

4. The system of claim 1, wherein the first piston is configured to move an additional sealing member of the seal assembly between sealed and unsealed positions between the seal assembly and a second tubular.

5. The system of claim 4, comprising the seal assembly, wherein the seal assembly comprises:

the sealing member configured to be engaged by an axial force applied to the sealing member as the first piston moves from the unsealed and sealed positions;

the additional sealing member configured to be engaged by the axial force applied to the additional sealing member as the first piston moves from the sealed and unsealed positions;

a first push member configured to engage with the running tool and move the sealing member in a first radial direction and the additional sealing member in a second radial direction;

the lock member configured to move in the second radial direction as the second piston moves from the unlocked to the locked positions; and a second push member configured to engage with the running tool and move the lock member in the second radial direction.

6. The system of claim 5, wherein the running tool is coupled to the seal assembly by a breech connection.

7. The system of claim 5, wherein the running tool is coupled to the seal assembly by one or more shear pins, such that the running tool may be disconnected from the seal assembly without applying a rotational force.

8. The system of claim 5, wherein the first piston is coupled to a third push member configured to direct the first push member in an axial direction, and wherein the second piston is coupled to a fourth push member configured to move the second push member in the axial direction.

9. The system of claim 8, wherein the first push member engages a surface of the additional sealing member, the additional sealing member comprises a first tapered surface, the sealing member comprises a second tapered surface, and the first tapered surface is configured to engage the second tapered surface when the first push member moves in the axial direction to move the sealing member in the first radial direction and the additional sealing member in the second radial direction.

10. The system of claim 8, wherein the second push member comprises a first tapered surface, the lock member comprises a second tapered surface, and the first tapered surface is configured to engage the second tapered surface when the second push member moves in the axial direction to direct the lock member in the second radial direction.

11. A system, comprising:

a running tool, comprising:

a tool body;

a first piston configured to move a sealing member of a seal assembly between sealed and unsealed positions between the seal assembly and a first tubular, wherein the first piston is disposed radially between first and second portions of the tool body; and a second piston configured to move a lock member between locked and unlocked positions between the seal assembly and a second tubular.

12. The system of claim 11, wherein the first piston and the second piston are coupled to one or more push members, wherein the first piston and second piston are configured to drive respective push members of the one or more push member to move the sealing member and the lock member respectively.

13. The system of claim 12, wherein the one or more push members comprise one or more push rods.

14. The system of claim 11, wherein the first piston is coupled to a first push member configured to direct a second push member in an axial direction to move the sealing member, and wherein the second piston is coupled to a third push member configured to move a fourth push member in the axial direction to move the lock member.

15. The system of claim 11, wherein the lock member comprises a first tapered surface configured to interface with a second tapered surface of a push member, wherein the first tapered surface runs along at least half a height of the lock member.

16. A system, comprising:

a running tool, comprising:

a tool body;

a first piston configured to move a sealing member of a seal assembly between sealed and unsealed positions between the seal assembly and a first tubular; and a second piston configured to move a lock member between locked and unlocked positions between the seal assembly and a second tubular;

wherein the running tool is configured to rotate less than a full rotation in a circumferential direction to release the running tool from the sealing assembly.

17. The system of claim 16, wherein the running tool is configured to rotate less than half of the full rotation in the circumferential direction to release the running tool from the sealing assembly.

18. The system of claim 16, wherein the running tool is configured to rotate less than a third of the full rotation in the circumferential direction to release the running tool from the sealing assembly.

19. The system of claim 16, wherein the running tool is configured to release the sealing assembly after the sealing member is moved to the sealed position between the seal assembly and the first tubular, wherein the sealed position has the sealing member disposed in a recess in the first tubular.

20. The system of claim 16, wherein the running tool is configured to release the sealing assembly after the sealing member is moved to the sealed position between the seal assembly and the first tubular and the lock ring is moved to the unlocked position between the seal assembly and the second tubular.

* * * * *